US009057252B2

(12) United States Patent
Bell

(10) Patent No.: US 9,057,252 B2
(45) Date of Patent: Jun. 16, 2015

(54) PRODUCT SAMPLING SYSTEM WITHIN SUBSEA TREE

(75) Inventor: Robert Bell, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 682 days.

(21) Appl. No.: 13/302,796

(22) Filed: Nov. 22, 2011

(65) Prior Publication Data

US 2013/0126183 A1 May 23, 2013

(51) Int. Cl.
*E21B 7/12* (2006.01)
*E21B 49/08* (2006.01)

(52) U.S. Cl.
CPC ..... *E21B 49/086* (2013.01)

(58) Field of Classification Search
USPC ..... 166/336, 344, 347, 357, 368, 250.01, 166/264, 75.12; 702/6, 12, 13
See application file for complete search history.

(56) References Cited

U.S. PATENT DOCUMENTS

| | | | | |
|---|---|---|---|---|
| 3,964,305 | A | 6/1976 | Wray et al. | |
| 6,212,948 | B1 | 4/2001 | Ekdahl et al. | |
| 6,338,276 | B1 | 1/2002 | Durando et al. | |
| 6,659,180 | B2 | 12/2003 | Moss | |
| 7,219,740 | B2 | 5/2007 | Saucier | |
| 7,261,161 | B2 | 8/2007 | Richards | |
| 7,311,151 | B2 | 12/2007 | Chitwood et al. | |
| 7,405,998 | B2 | 7/2008 | Webb et al. | |
| 7,548,873 | B2 | 6/2009 | Veeningen et al. | |
| 7,665,519 | B2 * | 2/2010 | Oddie | 166/264 |
| 8,574,351 | B2 * | 11/2013 | Elms et al. | 95/258 |
| 2005/0028974 | A1 * | 2/2005 | Moody | 166/264 |
| 2009/0166037 | A1 * | 7/2009 | Sroka | 166/264 |
| 2010/0044037 | A1 * | 2/2010 | Volsin | 166/264 |

FOREIGN PATENT DOCUMENTS

| | | | |
|---|---|---|---|
| GB | 2460068 | A | 12/2009 |
| WO | 9102948 | A1 | 3/1991 |
| WO | 9105135 | A1 | 4/1991 |

OTHER PUBLICATIONS

GB Combined Search and Examination Report dated Feb. 8, 2013 from corresponding Application No. GB1220862.5.
GB Search and Examination Report issued May 15, 2014 in connection with corresponding GB Patent Application No. GB1220862.5.

* cited by examiner

*Primary Examiner* — Matthew Buck
*Assistant Examiner* — Aaron Lembo
(74) *Attorney, Agent, or Firm* — Bracewell & Giuliani LLP

(57) ABSTRACT

A method and system for producing fluid from a subsea wellbore. An amount of fluid is sampled from fluid being produced and retained for a period of time until constituents in the fluid stratify. A fluid characteristic is sensed at spaced apart vertical locations in the sampled fluid. A water fraction as well as gas content can be ascertained from sensing the sampled fluid. The fluid characteristic is used for calibrating a multi-phase flowmeter that measures flow of the fluid being produced from the wellbore.

18 Claims, 2 Drawing Sheets

PRODUCT SAMPLING SYSTEM WITHIN SUBSEA TREE

BACKGROUND

1. Field of Invention

The invention relates generally to a system and method for sampling a connate fluid subsea. More specifically, the present invention relates generally to a method and device for automatically sampling fluid at a subsea wellhead.

2. Description of Prior Art

Subsea wellbores are formed from the seafloor into subterranean formations lying underneath. Systems for producing oil and gas from subsea wellbores typically include a subsea wellhead assembly set over an opening to the wellbore. Subsea wellheads usually include a high pressure wellhead housing supported in a lower pressure wellhead housing and secured to conductor casing that extends downward past the wellbore opening. Wells are generally lined with one or more casing strings coaxially inserted through, and significantly deeper than, the conductor casing. The casing strings are typically suspended from casing hangers landed in the wellhead housing. One or more tubing strings are usually provided within the innermost casing string; that among other things are used for conveying well fluid produced from the underlying formations. The produced well fluid is typically controlled by a production tree mounted on the upper end of the wellhead housing. The production tree is typically a large, heavy assembly, having a number of valves and controls mounted thereon Well fluids can be produced from a subsea well after the wellhead assembly is fully installed and the well completed. Produced well fluid is generally routed from the subsea tree to a manifold subsea, where the fluid is combined with fluid from other subsea wells. The combined fluid is then usually transmitted via a main production flow line to above the sea surface for transport to a processing facility. Often, a pump is required for delivering the combined produced fluid from the sea floor to the sea surface. Thus knowledge of the well fluid flow and constituency is desired so the pump and flow line can be adequately designed. While the fluid is often analyzed at sea surface, fluid conditions, e.g. temperature, pressure, are generally different subsea. Moreover, the respective ratios of fluid components, as well as the components themselves, often change over time. As such, a time lag of knowledge of the fluid in the flow lines may occur.

SUMMARY OF THE INVENTION

Disclosed herein is a method of and system for producing fluid from a subsea wellbore. In one example the method includes obtaining an amount of fluid produced from the wellbore, where the fluid obtained is referred to as sampled fluid. The sampled fluid is isolated in a container that is adjacent the wellbore. The sample fluid is sensed at locations that are vertically spaced apart, where the sensing takes place over a period of time after the sampled fluid is obtained. Using the information obtained by sensing, a constituent of the sampled fluid is identified. The method can further include identifying stratification of the sampled fluid into phases based on the step of sensing. The container can be mechanically coupled to a production tree mounted over the subsea wellbore. In an example, the fluid produced from the wellbore flows through a flowmeter; in this example the method further involves adjusting a value of a measurement obtained using the flowmeter based on the step of identifying a constituent of the sampled fluid. In one example embodiment, an amount of water in the sampled fluid and the flowmeter is a multi-phase flowmeter is identified. The method may optionally further include estimating a percentage an identified constituent makes up of the total sampled fluid. In one alternate embodiment, the steps of obtaining and retaining the sampled fluid include flowing the amount of fluid into a sample flow line having valves and closing the valves to isolate the sampled fluid between the valves in the sample flow line. Optionally, the step of sensing includes measuring a property of a discrete portion of the sampled fluid with a sensor disposed at each of the vertically spaced locations. The method may further include releasing the amount of sampled fluid from the container and into a production flow line that transmits fluid produced from the wellbore.

Also disclosed herein is a subsea wellhead assembly, that in one example embodiment is made up of a wellhead housing mounted over a subsea wellbore, a production tree coupled to the wellhead housing, a production flow line in fluid communication with the production tree, and a sample circuit. The sample circuit includes a container selectively in fluid communication with the production flow line and a sensor system. The sensor system has fluid sensors that are in communication with vertically spaced points along an inside of the container. Optionally, the sample circuit further includes an inlet in fluid communication with the production flow line, an outlet in fluid communication with the production flow line, an inlet valve in fluid communication with the inlet, and an outlet valve in fluid communication with the outlet, and wherein the container is defined between the inlet and outlet valves. In one alternate embodiment, a value characterizing flow through the production flow line is measured with a flowmeter and the value is adjusted based on an output of the sensor system. Optionally, the sensor system is in communication with the flowmeter through a control module provided on the production tree.

A method of producing fluid from a subsea well is disclosed that involves retaining an amount of fluid produced from the well in a sealed environment that is subsea and proximate the subsea well and sensing a characteristic of the fluid at discrete vertically spaced apart locations in the sealed environment. A rate of flow of fluid produced from the well is measured and adjusting the measured rate of flow based on a result of the sensing. Optionally, a multi-phase flowmeter is used to measure a rate of flow of fluid and wherein the step of adjusting includes calibrating the flowmeter. In one alternate embodiment, the step of sensing takes place over a period of time ranging up to at least about 10 hours. Alternately, sensing is repeated until water and hydrocarbon liquid in the fluid being retained has substantially stratified.

BRIEF DESCRIPTION OF DRAWINGS

Some of the features and benefits of the present invention having been stated, others will become apparent as the description proceeds when taken in conjunction with the accompanying drawings, in which.

Figure 1:
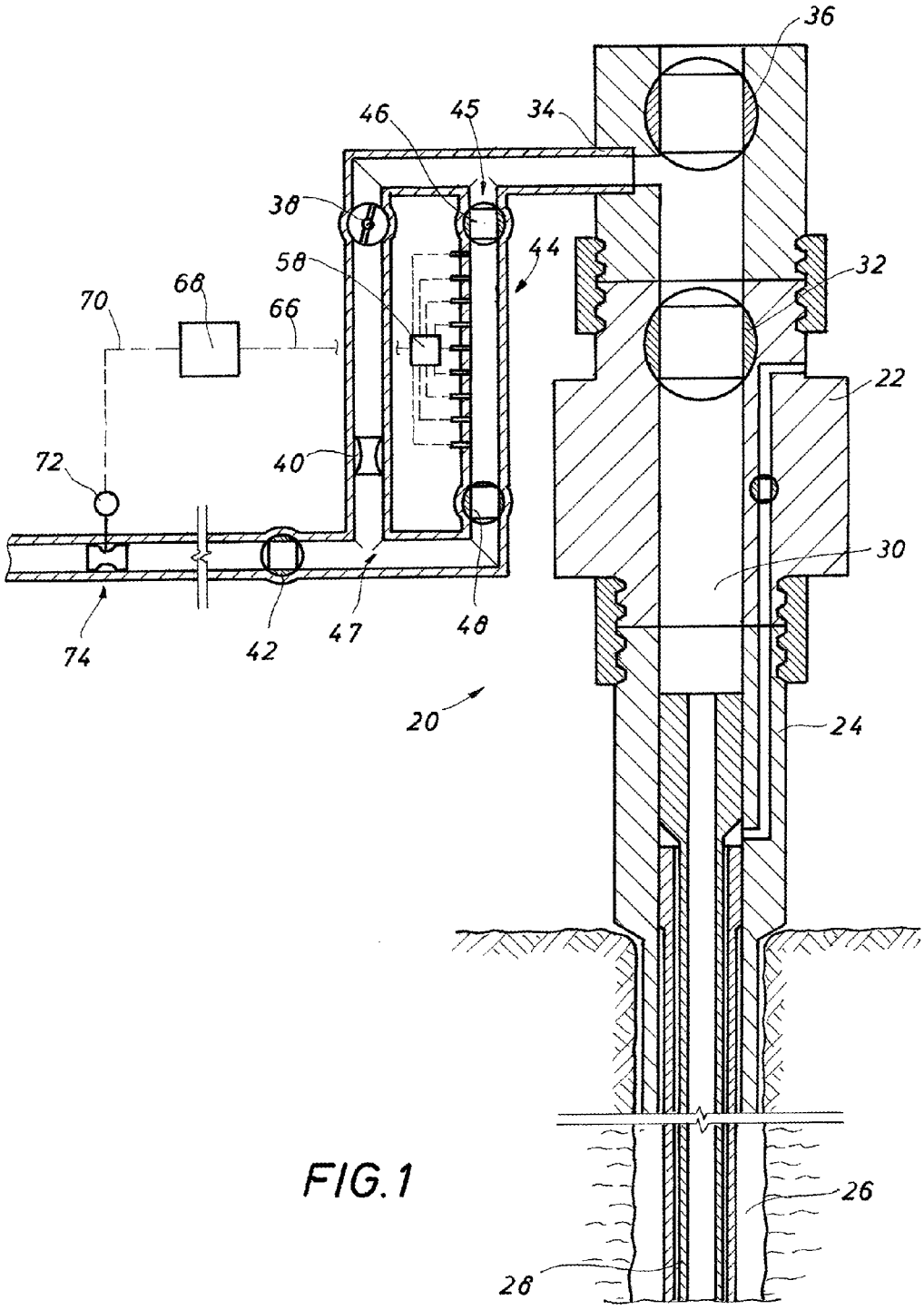
FIG. 1 is a side sectional view of an example embodiment of a wellhead assembly with a sampling system in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

An example embodiment of a wellhead assembly 20 is shown in a side sectional view in FIG. 1. In the example of FIG. 1, the wellhead assembly 20 includes a production tree 22 coupled on a wellhead housing 24; where the wellhead housing 24 is shown mounted over a wellbore 26. An amount of annular production tubing 28 extends downward from within the wellhead housing 24 and into the wellbore 26. A main bore 30 is shown extending axially within the wellhead housing 24 further upward into the production tree 22. A main valve 32 is set within the main bore 30 and in the portion circumscribed by the production tree 22. Selective opening, or closing, of the main valve 32 communicates, or isolates, fluid in the production tubing 28 and a production line 34 laterally projects through the production tree 22 above the main valve 32. A swab valve 36, shown above the main valve 32 and in the main bore 30, isolates an upper end of the main bore 30 from outside of the wellhead assembly 20. A wing valve 38 is shown set within the production line 34 for isolating various portions of the production line 34 from one another. Also shown within the production line 34 is a choke 40 for regulating and/or controlling flow of fluid through the production line 34. Further downstream from the choke 40 is an isolation valve 42 for providing additional isolation of fluid communication through the production line 34.

Further shown in the example embodiment of FIG. 1 is a sampling circuit 44 having an inlet 45 in fluid communication with the production flow line 34 and an inlet valve 46 set just downstream of the inlet 45 and within the sample circuit 44. Similarly, an outlet 47 of the sampling circuit 44 defines where an end of the sample circuit 44 intersects with the production line 34. A sample valve 48 is provided in the sample circuit 44 and upstream of the outlet 47. In the example embodiment of FIG. 1, the sample circuit 44 is made up of an annular passage defined in the space between the inlet and outlet valves 46, 48.

In one example of operation of the sample circuit 44, inlet valve 46 is moved from a closed to an opened position, thereby providing for fluid communication between the production line 34 and inside of the sample circuit 44. Outlet valve 48 may also be opened thereby fully filling the sample circuit 44 with fluid produced from inside of the wellbore 26 and to flush out any other fluids, such as air, or residual fluid from a previous sampling, thereby ensuring a true and accurate sample. To regulate the amount of flow passing into the sample circuit 44, the choke 40 may be urged into a restricted or closed position thereby forcing more flow of fluid through the sample circuit 44. When it is determined that fluid fully fills the sample circuit 44, inlet and outlet valves 46, 48 can be closed thereby retaining and isolating the sampled fluid from the wellbore 26 within the sample circuit 44.

Figure 2C:
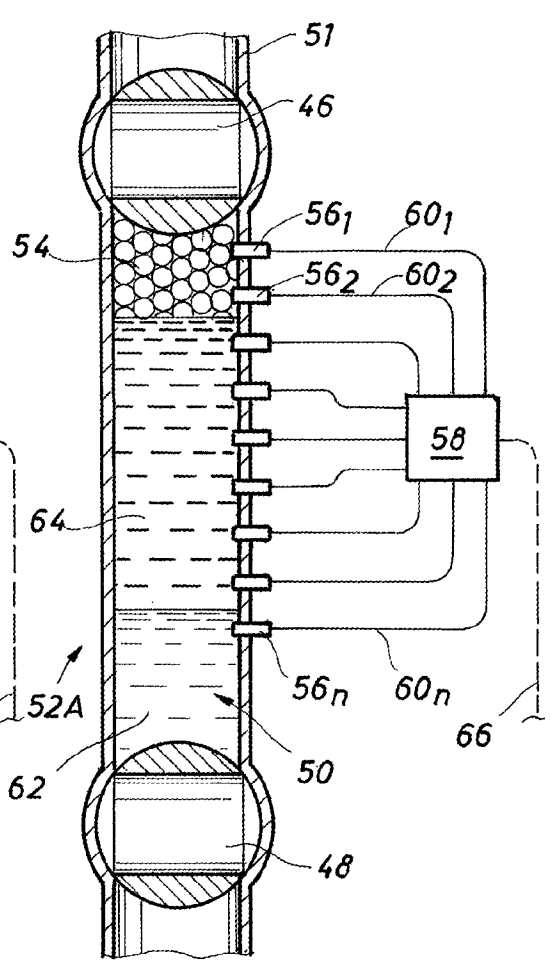
FIGS. 2A-2C are side sectional views of an example details of an embodiment of the sampling system of FIG. 1.
Figure 2B:
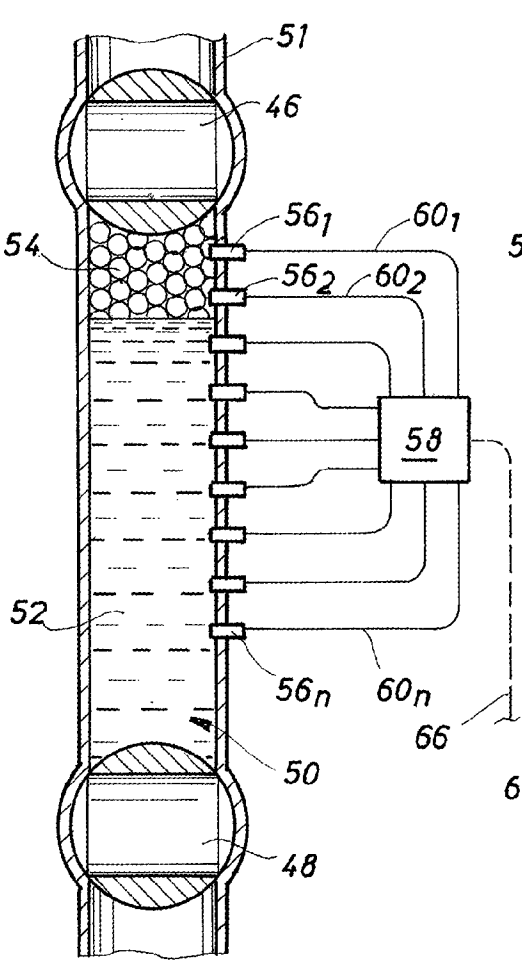
Figure 2A:
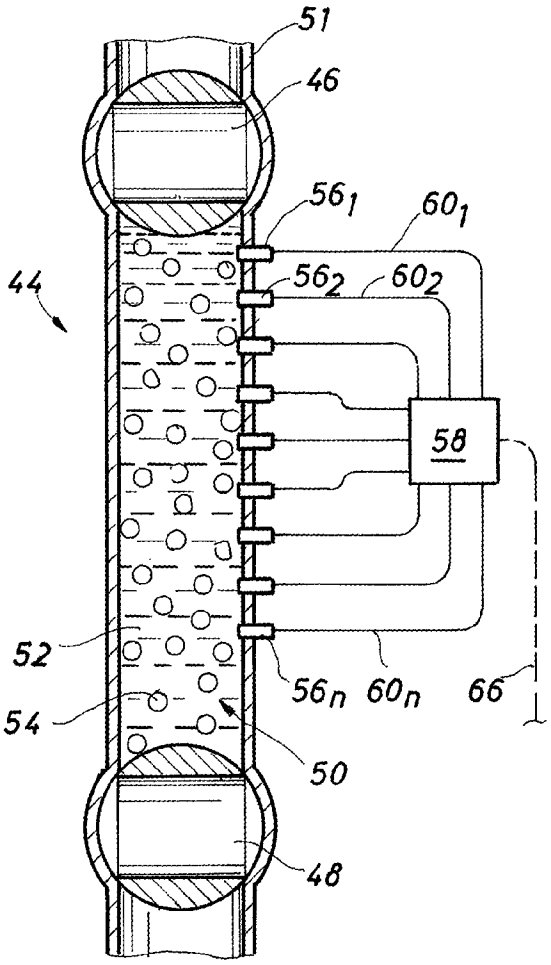

FIGS. 2A through 2C show in one example embodiment sensing of the fluid retained within the sample circuit 44. Specifically referring to FIG. 2A, sampled fluid 50 fills the space defined by the valves 46, 48 and walls of a container 51 making up the sample circuit 44. In the example of FIG. 2A, the container 51 is a tubular member. In an alternate embodiment the portion of the sample circuit 44 between the valves 46, 48 includes a passage (not shown) formed through a substantially solid member, such as the production tree 22. In an example embodiment depicted in FIG. 2A, constituents of the fluid 50 include liquid 52 and gas 54. The walls of the container 51 having the fluid 50 define a vessel. Sensors $\mathbf{56}_1 \ldots \mathbf{56}_n$ are shown in the wall of the container 51 and in communication with the fluid 50 within the sample circuit 44. In one example embodiment, the sensors $\mathbf{56}_1 \ldots \mathbf{56}_n$ measure various fluid properties, such as density, viscosity, temperature, pressure, and the like, and may use resistance, capacitance, or other means for measuring these properties. Further, the sensing of the fluid properties can characterize the fluid adjacent each of the sensors $\mathbf{56}_1 \ldots \mathbf{56}_n$. The sensors $\mathbf{56}_1 \ldots \mathbf{56}_n$ are shown having an end coupled to a signal line $\mathbf{60}_1 \ldots \mathbf{60}_n$, wherein the distal end of these lines $\mathbf{60}_1 \ldots \mathbf{60}_n$ coupled to a controller 58. In an example embodiment, the controller 58 sends and/or receives data signals, can process the data signals, and can run executable code in response to receiving/sending a data signals. In one example, the controller 58 includes an information handling system.

Referring now to FIGS. 2B and 2C, in FIG. 2B the sample fluid 50 is shown after a period of time when the gas 54 has stratified and separated from the liquid 52. As such, position of sensors $\mathbf{56}_1, \mathbf{56}_2$ are positioned at discreet vertical locations along the wall of the container 51 and provide information about the gas constituent of the fluid 50. Moreover, when compared to what is sensed by sensors $\mathbf{56}_3 \ldots \mathbf{56}_n$, the gas content of the fluid 50 may be estimated. In FIG. 2C, the fluid 50 is shown further stratified such that the liquid 52A has separated into a water fraction 62 shown residing adjacent the outlet valve 48 and a hydrocarbon fraction 64 that extends in the liquid column 52A on the upper end of the water fraction 62 to a lower end of the gas fraction 54. Further, the strategically disposed sensors $\mathbf{56}_1 \ldots \mathbf{56}_n$, being set substantially along the entire length of the container 51, can be used to detect where in the container 51 are interfaces between the different types of fluids making up the produced fluid so that a mass percent of produced fluid may be estimated. It is believed it is within the capabilities of those skilled in the art to ascertain fluid composition based on output from the sensors $\mathbf{56}_1 \ldots \mathbf{56}_n$.

Further illustrated in FIG. 2C is a signal line 66 that provides communication between the controller 58 and a service control module 68 (FIG. 1). Referring back to FIG. 1, the service control module 68 is further illustrated in signal communication via a signal control line 70 with a flow indicator 72. The flow indicator 72 is associated with a flowmeter 74 that is disposed in the production flow line downstream of the isolation valve 42. The flowmeter 74 which in one example embodiment is a multiphase flowmeter, can be upstream of a manifold (not shown) where production lines from other subsea wells are combined into a single flow line.

As is known, the accuracy of multiphase flow meters can be significantly improved by a rough estimation of the different fluid phases within the total flow, such as the total water cut in the flow. Thus, in one example of operation, the information about the sampled fluid 50 can be integrated with a measured flow rate through the flow meter 74 to further calibrate the flowmeter 74 and thereby arrive at a more precise and accurate actual flow through the flowmeter 74.

One of the advantages of the method and device disclosed herein is that automatic fluid sampling may be achieved without need for remote intervention such as that from a remotely operated vehicle. Optionally, the time at which the sampled fluid 50 is obtained and allowed to stratify can range up to a few hours and in excess of a few days, as well as up to a hundred hours.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of producing fluid from a subsea wellbore through a subsea production tree mounted over the subsea wellbore and out a production flow line extending from the tree, comprising:

a. connecting an inlet of a sampling conduit into the flow line and an outlet of the sampling conduit into the flow line at a location downstream from the inlet;

b. providing the sampling conduit with an inlet valve and an outlet valve downstream from the inlet valve, defining a container between the inlet valve and the outlet valve that has sensors at vertically spaced apart locations inside the container;

c. opening the inlet and outlet valves, thereby diverting some of the fluid flowing through the flow line into the sampling conduit, then closing the inlet and outlet valves, thereby isolating an amount of sampled fluid in the container from the fluid flowing through the flow line;

d. sensing the sampled fluid with the sensors over a period of time;

e. identifying a constituent of the sampled fluid based on the step of sensing; then f. opening the inlet and outlet valves to allow the sampled fluid to flow through the outlet valve into the flow line.

2. The method of claim 1, wherein step (e) further comprising identifying stratification of the sampled fluid into phases.

3. The method of claim 1, wherein the flow line has a choke through which the well fluid flows, and wherein step (a) compises placing the outlet of the sampling conduit upstream from the choke.

4. The method of claim 1, wherein the fluid flowing through the flow line flows through a flowmeter, the method further comprising adjusting a value of a measurement obtained with the flowmeter based on the constituents identified in step (e).

5. The method of claim 4, wherein step (e) comprises identifying an amount of water in the sampled fluid and calibrating the flowmeter based on the amount of water identified in the sampled fluid.

6. The method of claim 1, wherein step (e) further comprises estimating a percentage that the identified constituent makes up of the total sampled fluid.

7. The method of claim 1, wherein step(e) comprise identifying whether the sampled fluid contains water, oil and gas.

8. The method of claim 1, wherein step (d) further comprises communicating data signals from the sensors to a controller, which performs step (e).

9. The method of claim 8, wherein the subsea production tree further comprises a service control module mounted to the subsea production tree; and the controller provides data signals resulting from step (e) to the service control module.

10. A subsea wellhead assembly comprising:

a wellhead housing mounted over a subsea wellbore;

a subsea production tree coupled to the wellhead housing;

a production flow line in fluid communication with the production tree;

a sample conduit having an inlet connected into the production flow line and an outlet connected into the production flow line downstream from the inlet, defining a container between the inlet and the outlet;

an inlet valve at the inlet of the sample conduit and an outlet valve at the outlet of the sample conduit;

the inlet and outlet valves having an open position that selectively diverts some of the well fluid flowing through the production line into the container and from the container back into the production flow line;

the inlet and outlet valves having a closed position that isolates a sample of the well fluid in the container from the well fluid flowing through the production flow line; and a sensor system comprising fluid sensors in the container at vertically spaced apart locations and that are in communication with vertically spaced points along an inside of the container,the sensors being configured to identify constituents of the sample of the well fluid.

11. The wellhead assembly of claim 10, wherein the fluid sensors are configured to identify stratification of the sample of the well fluid that occurs when the inlet and outlet valves are in the closed position over a selected period of time.

12. The wellhead assembly of claim 10, further comprising:

a flow meter located in production flow line that provides a value characterizing flow rate through the production flow line; and means for adjusting the value based on an output of the sensor system.

13. The wellhead assembly of claim 10, wherein the sensor system further comprises a controller that receives signals form the sensors.

14. A method of producing well fluid from a subsea well through a subsea production tree and out a production flow line extending from the tree, comprising:

a. connecting an inlet of a sampling conduit into the flow line and an outlet of the sampling conduit into the flow line at a located downstream from the inlet;

b. diverting a portion of the well fluid flowing through the flow line into the inlet of the sampling conduit; then c. trapping a sample of the well fluid within the conduit and allowing the sample to stratify over a period of time; then d. sensing a characteristic of the sample at discrete vertically spaced apart locations and determining whether the sample contains oil, water and gas occurring in stratified layers within the sampling conduit;

e. measuring a rate of flow of the well fluid flowing through the flow line;

f. adjusting the measured rate of flow based on the determination from step (d); and g. flowing the sample trapped in step (c) from the sampling conduit through the outlet back into the flow line.

15. The method of claim 14, wherein a multi-phase flowmeter is used to measure a rate of flow in step(e) and wherein step (f) comprises calibrating the flowmeter.

16. The method of claim 14, wherein the period of time in step (c) may be up to 10 hours.

17. The method of claim 14, wherein step (c) comprises isolating the sample from contact with the well fluid flowing through the flow line.

18. The method of claim 14, wherein the characteristic of the sample sensed is selected from the group consisting of fluid density, fluid composition, fluid pressure, fluid viscosity, and fluid temperature.

* * * * *